United States Patent [19]

Kesselring et al.

[11] Patent Number: 4,481,949

[45] Date of Patent: Nov. 13, 1984

[54] PACIFIER

[75] Inventors: Lutz Kesselring; Horst Frödrich, both of Zeven, Fed. Rep. of Germany

[73] Assignee: MAPA GmbH Gummi-und Plastikwerke, Zeven, Fed. Rep. of Germany

[21] Appl. No.: 351,910

[22] Filed: Feb. 24, 1982

[30] Foreign Application Priority Data

Mar. 4, 1981 [DE] Fed. Rep. of Germany ..... 3108094

[51] Int. Cl.[3] ..... A61J 17/00

[52] U.S. Cl. ..... 128/360; 215/11 R

[58] Field of Search ..... 128/359, 360, 133; 215/11 R; 119/71; 24/213 R

[56] References Cited

U.S. PATENT DOCUMENTS

| | | | |
|---|---|---|---|
| Re. 30,526 | 2/1981 | Hurst et al. | 128/360 |
| 4,381,785 | 5/1983 | Robbins | 128/359 |
| 4,402,321 | 9/1983 | Borg | 128/359 |

FOREIGN PATENT DOCUMENTS

| | | | |
|---|---|---|---|
| 561220 | 8/1958 | Canada | 128/360 |
| 2656819 | 6/1977 | Fed. Rep. of Germany | 128/360 |
| 2657871 | 6/1978 | Fed. Rep. of Germany | 128/360 |

*Primary Examiner*—C. Fred Rosenbaum
*Assistant Examiner*—J. L. Kruter
*Attorney, Agent, or Firm*—Toren, McGeady and Stanger

[57] ABSTRACT

A pacifier or dummy includes a resilient nipple, a guard, and a plug body inserted into the end of the tubular portion of the nipple that is opposite to the mouthpiece. The plug body is carried by a base, which is supported by the guard and is resilient in the direction of the longitudinal axis of the nipple. The plug has projections, which are particularly formed with beveled surfaces and movable along the axis of the nipple. The guard is provided with beveled surfaces adjacent to an opening in the guard. In response to a pull on the nipple, the base is resiliently deformed and the projections of the plug move toward the beveled surfaces of the guard. The plug body has outwardly protruding projections, which are oversize with respect to the clearance between lugs formed on the guard in the opening.

18 Claims, 7 Drawing Figures

PACIFIER

FIELD OF THE INVENTION

This invention relates to a pacifier or dummy comprising an elastic nipple consisting of a mouthpiece and a tubular portion, a guard having an opening through which said tubular portion extends, and a plug, which comprises a plug body, which extends into that end of the tubular portion which is opposite to the mouthpiece, and a base, which is supported by the guard on that side thereof which is opposite to the mouthpiece.

DESCRIPTION OF THE PRIOR ART

It is known that the guard can be provided at its opening with beveled surfaces for locating the tubular portion in conjunction with complementary beveled surfaces. This is included.

Such a pacifier or dummy is known from Austrian patent specification No. 338,440. In that known device, the base for a plug body which has a larger thickness in the tubular portion, consists of a hemispherical cover cap, which is substantially outwardly curved and is secured by a snap joint, adhesive joint or welded joint to a thicker portion of the guard, which thicker portion is disposed adjacent to and surrounds the opening in the guard. The beveled surfaces for locating the tubular body are provided on that edge of the opening in the guard which faces the guard and in one embodiment constitute a widened portion of that edge of said opening which faces the mouthpiece, and the plug body which has been inserted into the tubular portion is hollow and formed with slots, which extend from that end of the plug body which faces the mouthpiece. As a result, the plug body comprises laminae, which tend to spring inwardly. Outwardly directed detent projections are provided at the ends of the blades and urge the adjoining part of the tubular portion against the beveled surfaces at the rim of the opening in the guard. In response to tension applied to the nipple in that embodiment, the blades of the plug body can spring back. That pacifier or dummy can be taken apart rather easily. The hemispherical base provided in the known device is shaped to be non-yieldable and if it were resilient the connections between the parts of the known pacifier or dummy would be loose.

It is also known from said Austrian patent specification that the plug body may widen in the shape of a frustum of a cone in order to effect an additional clamping of the rolled-up edge of the nipple at that portion which faces the hemispherical cover cap or base. As a result, that rolled-up edge is always compressed against the guard at an edge which extends at right angles to the longitudinal axis of the plug body. This does not strengthen the connections between the parts of the assembly.

It is also known to provide a circular or oval cross-section adjacent to the tubular portion.

Austrian patent specification No. 339,501 discloses a pacifier or dummy which has a flat plug body that is provided at its narrow sides with projections, which are received by mating outwardly bulged portions of the tubular portion. But when the device has been assembled said arrangement is disposed beside the opening in the guard and serves to define the position of the nipple on the plug body relative to the guard.

SUMMARY OF THE INVENTION

It is an object of the invention so to design a pacifier or dummy of the kind described first hereinbefore that the parts of the device, particularly the only three parts of the device consisting of the nipple and of two parts which are particularly made from plastic material and consist of the guard and of the plug body and base are held more firmly together and the connections between these parts will be even strengthened in response to a pull exerted on the nipple.

This object is accomplished according to the invention in that the base is resilient in the direction of the longitudinal axis of the nipple and the plug has projections, which interengage with the tubular portion and are movable along the axis of the nipple and preferably comprise beveled surfaces of the plug body, and are adapted to respond to tension applied to the nipple in that said projections are moved toward beveled surfaces of the guard adjacent to the opening therein so as to increasingly clamp the tubular portion in conjunction with a resilient deformation of the base.

As a result of this compliance only in an axial direction, the clamping at said surfaces, which are preferably beveled, can be increased in response to tension and a centering action can be effected at the same time, whereas the parts will return to their normal position in response to a relief so that the strain on the material of the nipple, consisting particularly of rubber, will be reduced.

In a desirable embodiment, the projections are provided on the resilient base of the plug so that pressure will be applied in direct response to the resilient yielding of the resilient base.

In accordance with another desirable feature of the pacifier or dummy projections are provided at two narrow sides of a flat plug body and are engaged by part of the tubular portion and said part is movable against an opposite surface of the guard upon a pull on the tubular portion. Within the scope of the invention, a suitable alignment can be ensured in that the opening in the guard and the cross-section of the plug body and the cross-section of the tubular portion are elongated and larger in one direction than in the other. This will be particularly advantageous if the nipple has a shape which is desirable from an orthodontic aspect. This is also included. The invention includes also a tubular portion which is circular in cross-section and a corresponding circular opening in the guard and a plug body which is circular in cross-section. In a preferred embodiment, projections are provided on a broadside of the plug body and are disposed behind an opening which is formed in the guard and receives the tubular portion, said projections rise from said opening and engage a bead of the tubular portion, and the rim of the opening in the guard is beveled inwardly on the side facing the base. In that embodiment, a yielding of the base will also result in a stronger clamping action.

Particularly in conjunction with a resiliently deformable base of the plug, the connections between the parts of the device can be strengthened in that, in a preferred embodiment, the outwardly protruding projections provided at the narrow sides of the flat plug body are oversize with respect to the clearance between lugs which are formed on the guard and extend into the opening thereof. This results in a particularly strong adhesion. This embodiment can be further improved in that the plug body is provided adjacent to the projections with openings, which extend toward the resilient base and are defined on the outside by webs of plug material adjacent to the projections, which webs are adapted to be resiliently forced inwardly. Owing to the properties of the plug body material, that web can be resiliently depressed and particularly can spring back so that in this embodiment the plug body, which is oversize adjacent to the projections, can be reliably inserted. In this connection, resilient inserts may be provided in the openings.

In another particularly preferred embodiment for use in conjunction with the above-mentioned oversize, the base is disclike and hinged to a plug body, which is formed with the beveled surfaces and with the outwardly extending projections, which are oversize with respect to the clearance between lugs formed on the guard and extending into the opening thereof. Owing to that hinge, the plug with its oversize projections can be threaded in an oblique direction through the opening in the guard, which opening is constricted in that region. The hinge may be provided by a constricted, flexible neck portion between the base and the plug body, which is provided with the beveled surfaces. In that connection a particularly preferred feature resides in that the annular rib comprises a step, which supports the rim of a disclike base and defines a recess for centering said base, and the disclike base is held in position in said recess owing to the elasticity of the base and the elasticity of the tubular portion held between confronting surfaces of the plug body and of the guard portion defining the opening.

In both embodiments, even an oversize plug body, particularly a plug body having oversize projections, can be inserted into the base to interengage therewith so that the plug body will be reliably locked in position. That embodiment constitutes a pacifier or dummy having two resilient elements, namely, the resilient base, which engages the guard, and plug body portions, such as the neck, or other plug body portions which carry the projections and permit the plug body to be folded as it is inserted and permit it to expand when it has been inserted. To facilitate the assembling the lateral projections of the plug body are rounded at that edge which merges into the end of the plug body.

In a particularly preferred embodiment the opening in the guard is flush with that surface of the guard which is on the same side as the mouthpiece, the guard is formed on the opposite side with an annular rib, which surrounds a recess, and the resilient base is disclike and held in position at the annular rib. In that case the resilience of the disclike base will be desirably utilized. The rim of the opening is preferably provided with inwardly directed lugs beside the recess, which lugs define between them a clearance which is smaller than the distance between the outer ends of the projections provided on the narrow sides of the plug body.

The invention covers also the provision of a flat plug body on a resilient disclike base which covers the region around the opening in the guard, and the provision of a plug body which has a length that is equal to the depth of the opening in the guard and which is oversize with respect to the clearance between inwardly protruding lugs provided in the opening in the guard, which lugs and projections are axially spaced apart and disposed adjacent to the opening when the plug body has been inserted.

In response to tension applied to the mouthpiece of the nipple, the projections extending into a recess formed in the rim of the opening in the guard will be pulled toward the mouthpiece so that the clamping action will be increased. In response to a relief, the at least two projections will return to a centered position so that the material of the tubular portion will be relieved.

The plug body, even if it is circular in cross-section, may be provided with an annular peripheral bead, which is associated with and conforms to a recess formed in the rim of the opening in the guard. The invention thus includes also a plug body which has an end portion that is constricted and circular in cross-section and disposed at the center of the disc-shaped base.

The resilient base may consist of webs which extend diagonally across the opening or which are star-shaped. In a particularly preferred embodiment the resilient base consists of a disc-shaped cover over the guard in a region which surrounds the opening therein so that a closure is also provided.

In a desirable embodiment, the plug body has an end portion that is constricted and particularly circular in cross-section and disposed at the center of the disc. The closing of the assembly on that side which faces away from the mouthpiece can be improved in that the resilient base consists of a disc-shaped cover over the guard in a region which surrounds the opening therein. This can also be used in conjunction with a flat plug body.

In the embodiment just described, the disc-like cover is held in position at protruding profiled portions of the guard, particularly at an annular rib of the guard, and can be fixed by any of the means described hereinbefore. The disclike cover consists preferably of plastic material. The substantially flat, disclike cover may have a wave-shaped profiled portion which surrounds the center of the cover so that a predetermined compliance can be provided for. For this purpose, the wall thickness of the disclike cover may be desirably selected and may decrease outwardly or toward the central portion.

BRIEF DESCRIPTION OF THE DRAWING

The invention will now be explained with reference to illustrative embodiments shown on the accompanying drawing, in which FIGS. 4 to 6 are partial sectional views or sectional views.

DESCRIPTION OF THE PREFERRED EMBODIMENTS

Figure 1:
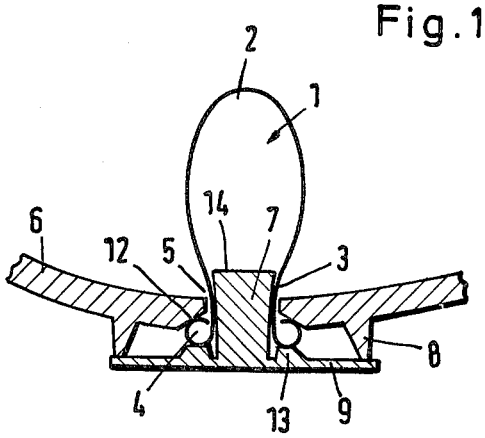
FIG. 1 is a diagrammatic side elevation showing a pacifier or dummy.

In all figures of the drawings, the interengaging portions are shown on an enlarged scale.

In the figures of the drawings, a nipple 1 consisting of a mouthpiece 2, which may have an orthodontically desirable shape, and a tubular portion 3 terminating in a rolled-up rim 4, are shown. The tubular portion extends through an opening 5 in a guard 6. The opening 5 conforms in cross-section to the cross-section of the tubular portion 3. A plug body 7 which has been inserted is similarly shaped in cross-section.

On the side facing away from the mouthpiece 2, the guard is formed around the opening 5 with a projecting portion 8, which may consist of a rib and to which a base 9 or 10 or 11 is secured, e.g., in that the rim of the base is adhesively joined to the projecting portion or in that said rim has been caused to snap into profiled clamping portions. The embodiments shown in FIGS. 1 to 3 have different bases.

The bases may consist of webs, star-shaped elements or the like and consist preferably of a disc.

In the embodiment shown in FIG. 1, the rim 12 of the opening 5 is beveled on the side facing the base 9 and tapers toward the mouthpiece 2. The rolled-up rim 4 of the nipple is disposed adjacent to the beveled surface. The disclike base 9 is resilient and in this embodiment carries projections 13, e.g., in the form of a peripheral annular bead adjacent to the rolled-up rim 4. The disclike base is connected to a centrally disposed plug body 7, which extends through the tubular portion 3 and holds the latter against the rim of the opening 5 and holds the rolled-up rim between the projections 13 and the beveled edge 12 of the opening. The plug body 7 flares toward its inner end 14 and may be provided there with an outwardly directed bead so that tension applied to the mouthpiece will cause the disclike base to bend inwardly so as to clamp the rolled-up rim with a progressively increasing force.

The disclike base 9 consists of a relatively thin disc, which may preferably be made of plastic material or may consist of metal.

Figure 2:
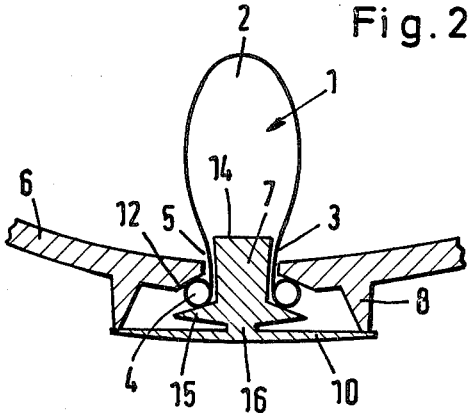
FIG. 2 is a view that is similar to FIG. 1 and shows another embodiment.

In the embodiment shown in FIG. 2 the plug body 7 has also a wider inner end and is provided with projections 15, which may constitute a peripheral annular collar, which holds and clamps the rolled-up rim 4 against the beveled edge 12 of the opening 5. The plug body 7 has a constricted end portion 16, which is circular in cross-section, even if the remainder of the plug is flat in cross-section. The end portion 16 is disposed at the center of the disclike base 10. That disc has a small thickness at its rim, which is secured to the projecting portion 8, and increases in thickness toward the central portion. That design provides for an adequate resilience.

Figure 3:
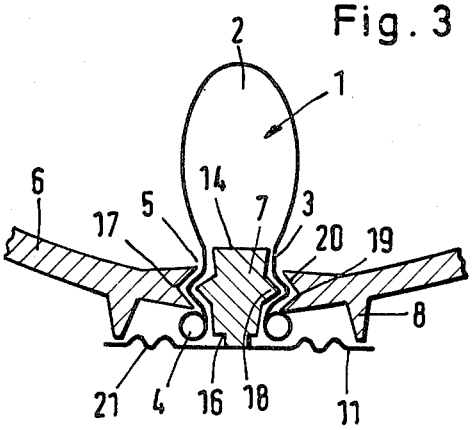
FIG. 3 is a view that is similar to FIG. 1 and shows a preferred embodiment. The various figures show also covers having different cross-sectional shapes.

In the embodiment shown in FIG. 3 the guard 6 is formed in the rim of the opening 5 with an outwardly directed, inwardly open recess 17 in the middle of the height of the rim. The projections 18 provided on the plug body may consist of a peripheral annular bead and conform to the recess 17 but are undersize so that the tubular portion 3 when pulled over the plug will have a bulge 19, which is initially held under a low contact pressure in the recess 17. The plug has a constricted end portion 16, which is secured to the disclike base 11 in one of the ways which have been described. The rolled-up rim 4 is disposed on the rear of the guard 6, below the disclike base 11.

Upon a pull on the mouthpiece 2, the plug body, which is closely embraced by the tubular portion 3 at the bead or at the projections 18, will be carried along so that a clamping is effected at the inwardly contracting wall surface 20 of the recess 17 and will result in an increase of the strength of the joint as the pull on the mouthpiece 2 is increased. Upon a release of the mouthpiece, the arrangement springs back to its centered position.

In the embodiment shown in FIG. 3, wave-shaped profiled portions extend around the center of the disclike base and permit an improvement or adjustment of its resilience.

The disclike bases 9 to 11 constitute also a centrally disposed cover over the central portion of the guard on that side which faces away from the mouthpiece 2.

Figure 4:
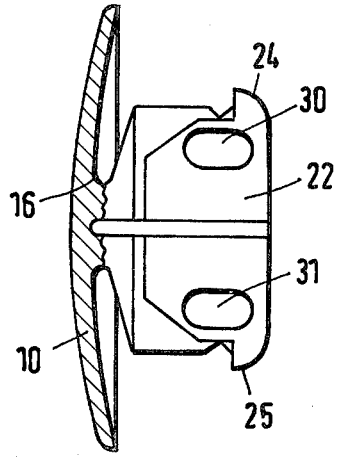
FIG. 4 is a top plan view showing a specially designed flat plug body and a resilient base.
Figure 5:
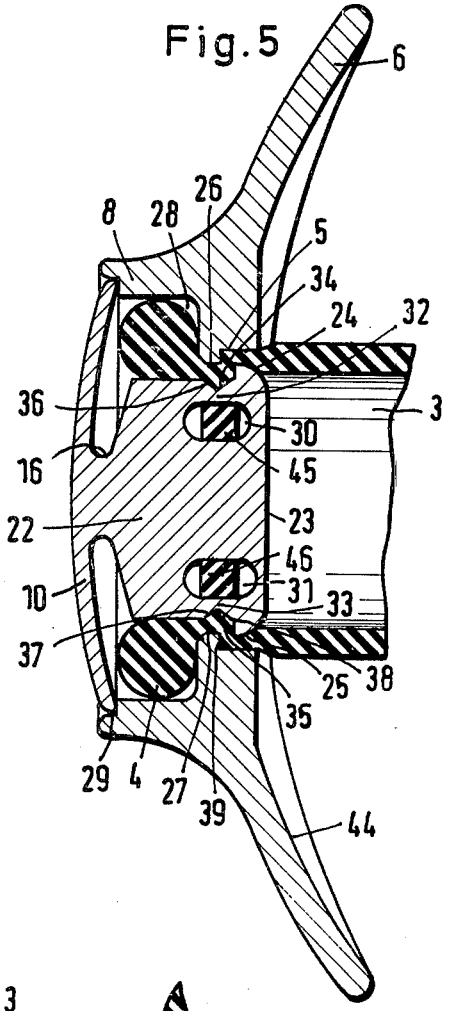
FIG. 5 is an enlarged view showing that plug body inserted in a guard.
Figure 6:
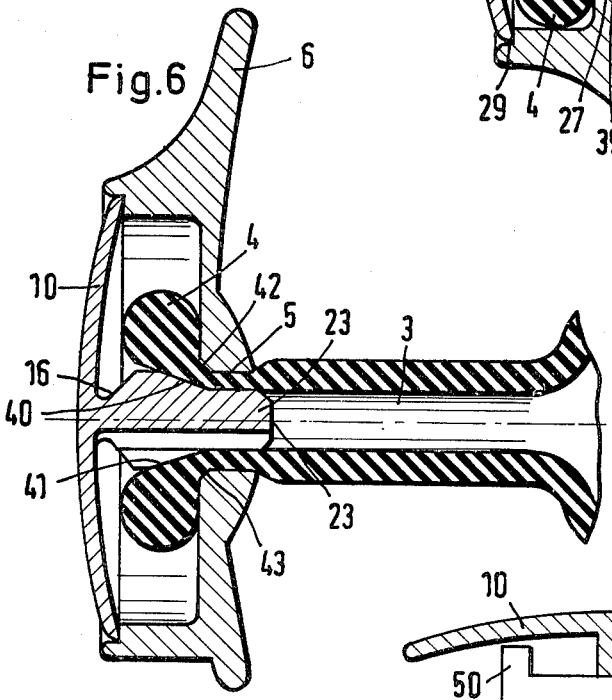
FIG. 6 is a side elevation corresponding to FIG. 5.

In FIGS. 4 to 6, a guard 6 and a base 10 are also apparent and it is seen that the resilient base is connected by a constricted end portion 16 to the flat plug body 22. The flat plug body is provided at its inserted end portion 23 with the outwardly directed projections 24, 25, which are oversize with respect to the clearance between inwardly directed lugs 26, 27 provided at the narrow ends of the opening in the guard. This is mainly apparent from FIG. 5. On that side of the lugs which faces away from the mouthpiece 2, the plug body defines inside the protruding rib 8 a chamber 28, which contains the rolled-up rim 4 of the nipple. As described hereinbefore, the resilient base 10 bears on the protruding portion 8, particularly on a step 29 of said portion.

As the plug body is inserted into the guard, the projections 24, 25 moving past the lugs 26, 27 are forced inwardly by the latter. The projections can yield because the plug body is formed adjacent to the projections 24, 25 with cavities 30, 31, which are defined on the outside by webs 32, 33, which can resiliently yield inwardly toward the opening 30 or 31. That resiliency is improved in that the webs 32, 33 taper toward the base at 36 or 37 on the outside, behind the projections 24, 25, e.g., owing to the provision of a beveled surface 34 or 35. That taper promotes the ability of the webs to yield inwardly. The resilient plastic material of the plug body ensures that the webs will stretch after the plug body has been inserted so that the projections 24, 25 and the lugs 26, 27 will interengage. It is virtually impossible to take the resulting assembly apart because the projections 24, 25 and the lugs 26, 27 have mutually confronting, parallel surfaces 38 and 39, respectively, and because said beveled surfaces 32, 33 defining a labyrinth-like passage for the tubular portion ensure that a pull on the mouthpiece will result in an increasingly stronger clamping action.

As is apparent from FIGS. 4 to 6, the plug body is provided at its narrow sides with wedgelike surfaces 40, 41, which rise toward the base 10 and face beveled surfaces 42, 43 of the rim of the opening in the guard 6. The inclinations may be different. This feature will also ensure that the rolled-up rim 4 of the nipple 1 will be increasingly clamped if a pull is exerted on the mouthpiece and that the plug body can yield owing to the resilience of the base.

The embodiment shown in FIGS. 4 to 6 affords the advantage that the end face of the inserted end portion 23 can be flush with the concave inner boundary surface 44 of the guard 6 because the reliable interengagement and the clamping means are restricted to the short region defined by the thickness of the guard.

As is particularly shown in FIG. 5, resilient inserts 45, 46 may be disposed in the cavities 30, 31 as resilient backings on the inside of the webs 32, 33. Such inserts may consist of rubber fillers in the openings, rubber buffers or transverse springs in the openings. Instead of rubber, a suitable plastic material may be used.

In that case an advantage will be afforded by the fact that the outwardly directed projections 24, 25 act on the webs 32, 33 virtually like levers tending to bend the webs 32, 33 inwardly, particularly because the latter are tapered at 36, 37.

Figure 7:
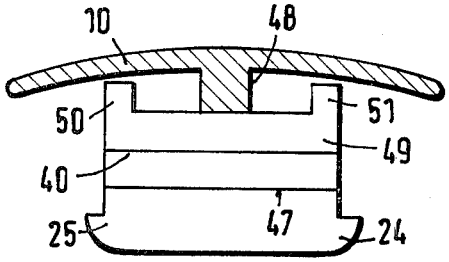
FIG. 7 is a view that is similar to FIG. 4 and shows another embodiment of a plug body and a resilient base.

As in the embodiment shown in FIG. 4, the plug 47 of FIG. 7 comprises a disclike base 10 consisting of a resiliently flexible disc, which is connected to the flat plug body 49 by a constricted neck 48. The latter is so small in cross-section that the disclike base 10 is hinged to the plug body. The neck 48 is flexible so that when the oversize projections 24, 25 are threaded in an oblique orientation into the opening in the guard 6 between the inwardly directed lugs 26, 27 (FIG. 5), the disclike base can be laterally displaced initially over the crest of the rib 8. As a result, that portion of the plug body 49 which is disposed above the projections 24, 25 can be reciprocated so that said projections are moved under the lugs 26, 27. When this has been accomplished, the rim of the disclike resilient base enters the step-shaped recess 29 at the crest of the rib 8 so that the plug body can be centered in such a manner that the projections 24, 25 in a symmetric arrangement engage the lugs 26, 27 from below. In that case the resilience of that part of the tubular portion 3 which extends between the described beveled surfaces and between the projections and lugs ensures a resilient and captive mounting. In this embodiment a plug body having projections 24, 25 which are substantially oversize can be inserted without exerting a nonpermissible stress on the material of the tubular portion.

Because the neck 48 is flexible, the elongated plug body 49 is suitably provided at its narrow ends under the disclike base 10 with upstanding abutments 50, 51, which are spaced below the base when the latter has been aligned. These abutments limit the pivotal movement of the disclike base 10.

The plug body is also provided on its longitudinal sides with the wedge surfaces 40, 41, which have been described with reference to FIG. 6 and rise toward the base 10. One of said surfaces is shown in FIG. 7.

In all embodiments shown and described, a guard (6) is provided, which is formed with a through opening (5) and on one side with axially protruding supporting means (8) spaced around said opening. A nipple (1) has a tubular portion (3), which extends through the opening (5), and a mouthpiece (2), which is integral with the tubular portion (3) and disposed on the other side of the guard (6). A plug comprises a plug body (7; 22; 49) and a base (9; 10; 11) connected to the plug body and disposed on said one side of said guard and bearing on said supporting means. The plug body extends into the opening (5) and is surrounded in part of its length by the tubular portion (3). The guard is formed with first clamping surfaces (12; 20; 26, 27), which are disposed on the outside of the tubular portion (3) and face the base. The plug is formed with second clamping surfaces (13; 15; 18; 34, 35), which are disposed on the inside of said tubular portion and face said first clamping surfaces. The first and second clamping surfaces comprise beveled surfaces. The tubular portion is in force-transmitting frictional contact with said plug body. The tubular portion (3) extends between said first and second clamping surfaces and is in force-transmitting frictional contact with said plug body in said opening. Said base is resilient in the longitudinal direction of said nipple to permit a movement of said second clamping surfaces toward said first clamping surfaces in said longitudinal direction whereby said tubular portion will be clamped more strongly between said clamping surfaces upon a pull on the mouthpiece.

What is claimed is:

1. In a pacifier comprising a guard having a first side and an oppositely directed second side with a through opening extending from the first side to the second side and with protruding supporting means spaced around said opening on said second side and extending outwardly from said second side in an axial direction of said through opening, an elastic nipple having a tubular portion, which extends through said opening, and a mouthpiece which is integral with said tubular portion and disposed on and spaced outwardly from the first side of said guard, said tubular portion having an axis extending generally parallel to the axis of said through opening, and a plug comprising a plug body and a base connected to said plug body and disposed on said second side of said guard and bearing on said supporting means, said plug body extending into said opening in said guard and being surrounded for a part of its length by said tubular portion, said plug body and said opening in said guard each having facing abutment surfaces including inclined surfaces, the improvement residing in that said guard comprises first inclined surfaces disposed on the outside of said tubular portion and facing said base, said first inclined surfaces being inclined relative to the axis of said through opening and tubular portion, said plug is formed with second inclined surfaces disposed on the inside of said tubular portion and facing said first inclined surfaces, said second inclined surfaces being inclined relative to the axes of said through opening and tubular portion, said base is resilient in the axial direction of said tubular portion of said nipple to permit movement of said second inclined surfaces toward said first inclined surfaces in the axial direction of said tubular portion, said plug body having projections thereon facing outwardly toward said guard so that during elastic deformation of said base said projections can be moved in the axial region of said through opening in said guard and are guided by said base relative to said guard, and said base is a flexible disclike member extending transversely of the axial direction of said tubular portion radially outwardly from and hinged to said plug body, and said disclike member bears axially against said supporting means in the form of a circumferentially projecting portion of said guard.

2. The improvement set forth in claim 1, wherein said first inclined surfaces and said second inclined surfaces are complementary to and face one another.

3. The improvement set forth in claim 1, wherein said tubular portion has a rolled-up rim at its end disposed on said second side of said guard and said second inclined surfaces are formed on said base and support said rolled-up rim.

4. The improvement set forth in claim 1, wherein said plug body has in cross-section an elongated shape having a major axis and a minor axis and is formed at the ends of said major axis with narrow side faces including at least some of said projections forming said second inclined surfaces, said tubular portion has at its end disposed on said second side of said guard a rolled-up rim bearing on said second inclined surfaces, whereby said rolled-up rim is clamped more strongly against said first inclined surfaces in response to a movement of said second inclined surfaces toward said first inclined surfaces in said axial direction of said tubular portion.

5. The improvement set forth in claim 1, wherein said plug body has in cross-section an elongated shape having a major axis and a minor axis and is formed with side faces which are parallel to said major axis and include some of said projections forming said second inclined surfaces tapering inwardly toward said mouthpiece, said guard is formed on said second side with a beveled surface which defines at least part of said opening and tapers in the same direction as said projections on said side faces and said beveled surfaces form at least some of said first inclined surfaces.

6. The improvement set forth in claim 1, wherein said guard is formed in said through opening with mutually opposite lugs which protrude into said opening, and said plug body has at least certain of said projections in register with said lugs and in spaced relation thereto.

7. The improvement set forth in claim 6, wherein said plug body is formed with cavities adjacent to said projections in register with said lugs and separated from said projections by respective resilient web portions adapted to be resiliently depressed and said web portions have outside surfaces which face said lugs and comprise at least certain of said second inclined surfaces.

8. The improvement set forth in claim 1, wherein said supporting means comprise an annular rib, which is formed with a radially inwardly open, annular recess, said base bears on said rib in said recess and covers the opening in said guard, said guard is formed at said openings with lugs, which protrude into said opening, at least certain of said projections on said plug body, are disposed on the first side of said guard and are axially spaced from and face respective ones of said lugs, and said tubular portion extends between said lugs and said projections.

9. The improvement set forth in claim 8, wherein said lugs and the facing said projections have parallel confronting surfaces defining a labyrinthlike passage and said tubular portion extends through said passage.

10. The improvement set forth in claim 1, wherein said plug body is hinged to said base by a flexible neck.

11. The improvement set forth in claim 10, wherein said rib is formed with a step defining said recess, said base has a rim which bears on said rib in and is centered by said recess, and said base is held in said recess by its own resilience and by the resilience of said tubular portion extending between said lugs and projections.

12. The improvement set forth in claim 1, wherein said base is formed with a wave-shaped portion, which is concentric with said plug body.

13. The improvement set forth in claim 1, wherein said circumferentially projecting portion comprises an annular rib and said base is secured to and covers said annular rib.

14. The improvement set forth in claim 1, wherein said base projects radially outwardly from said plug body.

15. The improvement as set forth in claim 1, wherein said plug body in cross-section extending transversely of the axial direction of said tubular portion has an elongated shape with a major axis and a minor axis, at least certain of said projections are located along the sides of the opening extending in the direction of the minor axis, said tubular portion has at its end disposed on said second side of said guard a rolled-up rim, said guard having inwardly directed lugs in surface contact with said rolled-up rim so that said rolled-up rim is located between said lugs and said base, said plug body having cavities therein with one said cavity adjacent each of said projections, a resilient web portion separating each of said cavities and the respective said projection, and said webs located between said cavities and the sides of said plug body extending in the direction of the minor axis and said webs forming a V-shaped recess in the outside surface of said plug body.

16. The improvement as set forth in claim 1, wherein said plug body in cross-section extending transversely of the axial direction of said tubular portion has an elongated shape with a major axis and a minor axis and the sides of said plug body extending in the direction of said major axis forming at least certain of said projections with said projections commencing adjacent said base and extending toward the opposite end of said plug body and said through opening in said guard closer to said base defining inclined surfaces facing toward said projections on said plug body and said tubular portion located between said projections on said plug body and said surfaces on said guard.

17. The improvement as set forth in claim 16, wherein said projections are spaced in the axial direction of said tubular portion from said lugs on said guard with said projections located closer to said first side of said guard with said tubular portion of said nipple located between said projections and said lugs, and said projections extending radially outwardly at least into the projection of said lugs extending in the axial direction of said tubular portion.

18. The improvement as set forth in claim 1, wherein said circumferentially projecting portion comprises an annular protruding rim extending outwardly from the second side of said guard in the axial direction of said tubular portion and spaced radially outwardly from the opening in said guard, said base is fitted within and in bearing engagement with said rib, said base covers the through opening in said guard, radially inwardly directed lugs formed in said through opening in said guard at the end of said through opening closer to said base, and at least certain of said projections on said plug body being spaced in the axial direction of said tubular portion from said lugs in the direction closer to the first side of said guard, and said tubular portion of said nipple being located between said lugs and at least certain of said projections.

* * * * *